US010342733B2

(12) United States Patent
Venosh

(10) Patent No.: US 10,342,733 B2
(45) Date of Patent: Jul. 9, 2019

(54) FLEXIBLE, FLAT POUCH WITH PORT FOR MIXING AND DELIVERING POWDER-LIQUID MIXTURE

(71) Applicant: Medtronic Xomed, Inc., Jacksonville, FL (US)

(72) Inventor: Lissa N. Venosh, Jacksonville, FL (US)

(73) Assignee: Medtronic Xomed, Inc., Jacksonville, FL (US)

( * ) Notice: Subject to any disclaimer, the term of this patent is extended or adjusted under 35 U.S.C. 154(b) by 92 days.

(21) Appl. No.: 15/046,153

(22) Filed: Feb. 17, 2016

(65) Prior Publication Data

US 2016/0158102 A1 Jun. 9, 2016

Related U.S. Application Data

(63) Continuation of application No. 12/048,056, filed on Mar. 13, 2008, now abandoned.

(51) Int. Cl.
*A61J 1/10* (2006.01)
*A61J 3/00* (2006.01)
(Continued)

(52) U.S. Cl.
CPC . *A61J 1/10* (2013.01); *A61J 3/00* (2013.01); *B65D 75/5877* (2013.01); *A61J 1/2096* (2013.01)

(58) Field of Classification Search
CPC ... A61J 1/10; A61J 3/00; A61J 1/2096; B65D 75/5877; A61F 2007/0012; A61F 2007/0002; B63C 2009/133; B63C 9/155
See application file for complete search history.

(56) References Cited

U.S. PATENT DOCUMENTS 1,304,114 A 5/1919 Staples
1,343,357 A * 6/1920 Eggers ..... A47C 7/021 128/118.1
(Continued)

FOREIGN PATENT DOCUMENTS

CN 2643906 Y 9/2004
FR 2691627 5/1992
(Continued)

OTHER PUBLICATIONS

PCT Search Report and Written Opinion for corresponding Int'l Application No. PCT/US09/035677 dated Jun. 17, 2009 (13 pgs).
(Continued)

*Primary Examiner* — Adam Marcetich
(74) *Attorney, Agent, or Firm* — Dicke, Billig & Czaja, PLLC

(57) ABSTRACT

A pouch for mixing and dispensing a composition including a pouch body and a port body. The pouch body includes opposing, first and second major flexible walls sealed to one another along respective peripheries thereof to define an internal chamber and a pouch perimeter. The pouch body has a C-like shape. The port body projects from the first wall and is fluidly open to the internal chamber. With this configuration, various components, such as a powder component and a liquid component, can be mixed by a user's hand(s) in pressing the walls in a kneading fashion, with the resultant composition being dispensed through the port body. In some embodiments, the pouch is provided to a user with a powder component pre-loaded in the internal chamber.

22 Claims, 6 Drawing Sheets

(51) Int. Cl.

| | |
|---|---|
| ***A61M 5/178*** | (2006.01) |
| ***B65D 75/58*** | (2006.01) |
| *A61J 1/20* | (2006.01) |

(56) References Cited

U.S. PATENT DOCUMENTS 3,158,188 A 11/1964 Esty
3,888,288 A 6/1975 Hickle et al.
3,951,127 A 4/1976 Watson et al.
4,097,366 A * 6/1978 Tanaka ..... B01J 8/0278 208/127
4,177,844 A 12/1979 Kuss et al.
4,193,506 A * 3/1980 Trindle ..... A61J 9/005 215/11.6
4,219,137 A * 8/1980 Hutchens ..... B65D 25/44 222/462
4,236,264 A * 12/1980 Britzman ..... A47C 7/383 297/393
4,316,489 A * 2/1982 Price ..... A47C 27/085 141/1
4,358,466 A 11/1982 Stevenson
4,434,712 A 3/1984 Ross et al.
4,451,383 A 5/1984 Arrhenius
4,470,164 A * 9/1984 Soderstrom ..... A47C 27/085 220/284
4,673,010 A * 6/1987 Prufer ..... A47C 27/085 141/1
4,693,400 A * 9/1987 Frahm ..... B65D 47/063 222/153.14
4,860,805 A * 8/1989 Townsend ..... A47C 27/085 141/286
4,887,912 A * 12/1989 Stumpf ..... B65D 75/5877 383/66
5,052,813 A * 10/1991 Latto ..... B01F 11/0074 366/101
5,056,171 A * 10/1991 Larson ..... A47C 27/085 141/386
5,090,075 A * 2/1992 Larson ..... A47C 27/085 141/114
5,174,162 A * 12/1992 Miyake ..... B01F 5/0609 250/437
5,230,335 A 7/1993 Johnson et al.
5,257,429 A * 11/1993 Genis ..... A47C 7/383 5/636
5,314,455 A 5/1994 Johnson, Jr. et al.
5,337,962 A * 8/1994 Erb ..... B05B 7/0876 239/424.5
5,377,838 A 1/1995 Segre
5,398,848 A 3/1995 Padamsee
5,431,308 A 7/1995 Tchen
5,451,179 A 9/1995 LaRoi et al.
5,462,526 A 10/1995 Barney et al.
5,566,869 A 10/1996 Katz
5,669,529 A 9/1997 Levit
5,676,830 A * 10/1997 Janik ..... G01N 30/74 210/198.2
5,731,021 A * 3/1998 Spector ..... B65D 1/0292 222/105
5,855,544 A 1/1999 Buchanan
5,938,089 A 8/1999 Abreu-Marston
5,961,210 A 10/1999 McCardel et al.
5,980,482 A 11/1999 Tofighi et al.
6,000,079 A * 12/1999 Dranger ..... A47C 4/54 425/522
6,076,967 A * 6/2000 Beaudette ..... B65D 33/2508 383/104
6,200,295 B1 3/2001 Burchett et al.
6,233,767 B1 * 5/2001 Horowitz ..... A47D 13/08 5/490
6,971,550 B2 12/2005 Kuge et al.
2001/0028601 A1 * 10/2001 Hiramatsu ..... B01F 3/0869 366/167.1
2002/0007155 A1 1/2002 Freund et al.
2002/0141664 A1 10/2002 Matsuda et al.
2003/0015452 A1 1/2003 Su
2003/0028971 A1 * 2/2003 Chaffee ..... A47C 7/021 5/706
2004/0007590 A1 1/2004 Hedington et al.
2004/0045842 A1 3/2004 Matsuda et al.
2004/0065315 A1 * 4/2004 Fish ..... A61F 7/03 126/263.08
2004/0106344 A1 * 6/2004 Looney ..... A61L 15/28 442/123
2004/0161504 A1 8/2004 Daniels et al.
2005/0126632 A1 6/2005 Farrell et al.
2005/0198969 A1 * 9/2005 Scudder ..... F25D 5/02 62/4
2005/0220721 A1 * 10/2005 Kablik ..... A61K 31/74 424/46
2006/0193540 A1 8/2006 Borchardt
2006/0257057 A1 11/2006 Andersen
2007/0068508 A1 * 3/2007 York-Leung Wong ..... A61F 7/034 126/263.02
2007/0127854 A1 * 6/2007 Smith ..... B65D 75/30 383/66
2007/0161932 A1 7/2007 Pick et al.
2007/0184087 A1 * 8/2007 Voigts ..... A61L 27/20 424/423
2007/0197950 A1 8/2007 Flick et al.
2008/0069857 A1 * 3/2008 Yeo ..... A61L 31/041 424/426
2008/0104764 A1 * 5/2008 Chen ..... A47C 7/383 5/644
2009/0036988 A1 * 2/2009 Peckham ..... A61B 17/56 623/17.16
2009/0121365 A1 * 5/2009 Jacobs ..... B01F 3/04503 261/76

FOREIGN PATENT DOCUMENTS

| | | |
|---|---|---|
| JP | 09075425 | 3/1997 |
| JP | 2000316951 | 11/2000 |
| JP | 2005529685 | 10/2005 |
| WO | 8400737 | 3/1984 |
| WO | 03086887 | 10/2003 |
| WO | 03105748 | 12/2003 |

OTHER PUBLICATIONS

Non-Final Office Action dated Apr. 21, 2010 for corresponding U.S. Appl. No. 12/048,056 (9 pgs).
Final Office Action dated Aug. 24, 2010 for corresponding U.S. Appl. No. 12/048,056 (11 pgs).
Advisory Action dated Nov. 3, 2010 for corresponding U.S. Appl. No. 12/048,056 (3 pgs).
Non-Final Office Action dated Jun. 26, 2012 for corresponding U.S. Appl. No. 12/048,056 (13 pgs).
Final Office Action dated Oct. 16, 2012 for corresponding U.S. Appl. No. 12/048,056 (15 pgs).
Advisory Action dated Jan. 11, 2013 for corresponding U.S. Appl. No. 12/048,056 (3 pgs).
Examiner's Answer to Appeal Brief dated Apr. 24, 2013 for corresponding U.S. Appl. No. 12/048,056 (19 pgs).
Patent Board Decision dated Dec. 17, 2015 for corresponding U.S. Appl. No. 12/048,056 (7 pgs).

* cited by examiner

FLEXIBLE, FLAT POUCH WITH PORT FOR MIXING AND DELIVERING POWDER-LIQUID MIXTURE

CROSS-REFERENCE TO RELATED APPLICATIONS

This application is a continuation of U.S. application Ser. No. 12/048,056, filed Mar. 13, 2008, and entitled "Flexible, Flat Pouch with Port for Mixing and Delivering Powder-Liquid Mixture"; the entire teachings of which are incorporated herein by reference.

BACKGROUND

The present disclosure relates to devices and methods for mixing components, such as powder and liquid components. More particularly, it relates to a mixing device, and related methods of use, facilitating convenient hand-mixing of components by a user and subsequent dispensing, for example in the preparation of a gelatinous, resorbable medical substance having hemostatic properties.

Many medical procedures, such as surgical procedures, entail application of a substance to a patient. In many instances, the substance to be applied is formed by a combination of two or more components, with the recommended protocol necessitating that some or all of the components not be combined with one another (e.g., mixed) until just prior to applying to the patient. In other words, the substance is provided to the caregiver in a partially complete form. One or more of the components may require special handling prior to mixing, the substance resulting from the combination may relatively quickly change states following mixing, etc. For example, bone or dental cement is commonly used to secure a prosthetic device to a bone of a patient, and is comprised of a powder polymer and a liquid monomer that polymerizes about the polymer powder; because the resultant bone cement will hardened shortly after mixing, the components are typically combined or mixed shortly before the surgical procedure.

For these and other medical procedures, the caregiver is required to perform the component mixing. While a mechanical mixing device may be appropriate, such devices are typically not available at a caregiver's site and/or require time and effort to properly operate. Further, it may be difficult to dispense the prepared substance from the device.

In light of the above, a need exists for a device that permits complete, manual mixing of components in forming a composition substance, such as a medical substance, and facilitates dispensing of the composition.

SUMMARY

Aspects of the present disclosure relates to a pouch for mixing and dispensing a composition. The pouch includes a pouch body and a port body. The pouch body includes opposing, first and second major flexible walls sealed to one another along respective peripheries thereof to define an internal chamber and a pouch perimeter. In this regard, the pouch body has a C-like shape. The port body projects from the first wall and is fluidly open to the internal chamber. With this configuration, various components, such as a powder component and a liquid component, can be mixed by a user's hand(s) in pressing the walls in a kneading fashion, with the resultant composition being dispensed through the port body. In some embodiments, the pouch perimeter defines opposing, first and second end edges and opposing, first and second side edges, with the end edges being substantially linear, and the side edges being curved. In other embodiments, the port body extends from the first wall in a perpendicular fashion relative to a common plane defined by the pouch perimeter such that when the second wall is placed on a flat surface, the port body extends perpendicular relative to the flat surface. In other embodiments, the pouch is provided to a user with a powder component pre-loaded into the internal chamber.

Other aspects in accordance with principles of the present disclosure relate to a method of preparing a composition. The method includes providing a pouch including a pouch body and a port body as described above. At least two materials are placed into the internal chamber. The materials are mixed within the internal chamber by repeatedly pressing the side walls toward one another by a user's fingers to create a mixed composition. Finally, the composition is dispensed from the internal chamber via the port body. In some embodiments, the method entails forming the pouch body to include an open end, dispensing a powder component into the internal chamber via the open end, and sealing the open end to contain the powder component.

DETAILED DESCRIPTION

Figure 1:
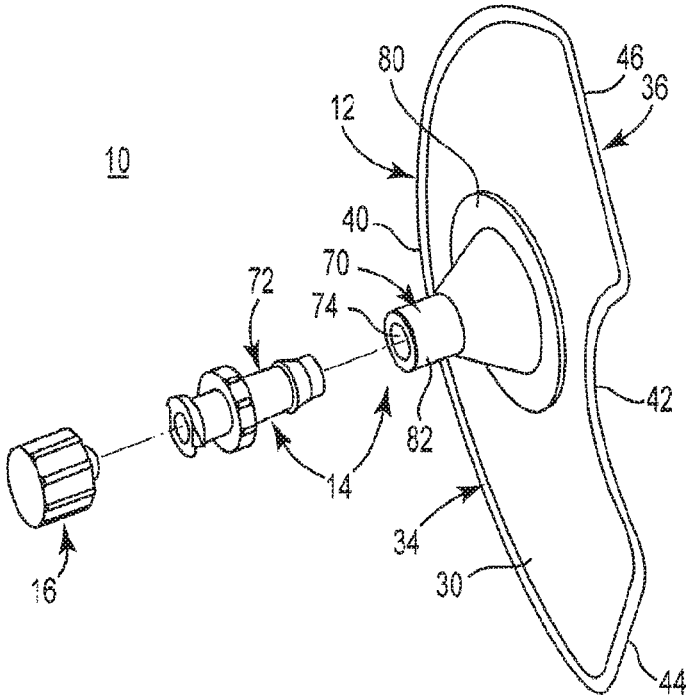
FIG. 1 is an exploded, perspective view of a pouch in accordance with principles of the present disclosure.

A pouch 10 in accordance with principles of the present disclosure for mixing and dispensing a composition is shown in FIG. 1. The pouch 10 includes a pouch body 12, a port assembly 14, and a cap 16. Details on the various components are provided below. In general terms, and with additional reference to FIG. 2, the pouch body 12 has a C-like shape, and defines an internal chamber 18. The port assembly 14 projects from the pouch body 12, and is fluidly connected to the internal chamber 18. Finally, the cap 16 is removably assembled to the port assembly 14 to facilitate selective access to the internal chamber 18. With this configuration, two or more components (not shown) can be mixed within the internal chamber 18 via manipulation of the pouch body 12, with the resultant composition (not shown) being dispensed from the internal chamber 18 via the port assembly 14.

Figure 2:
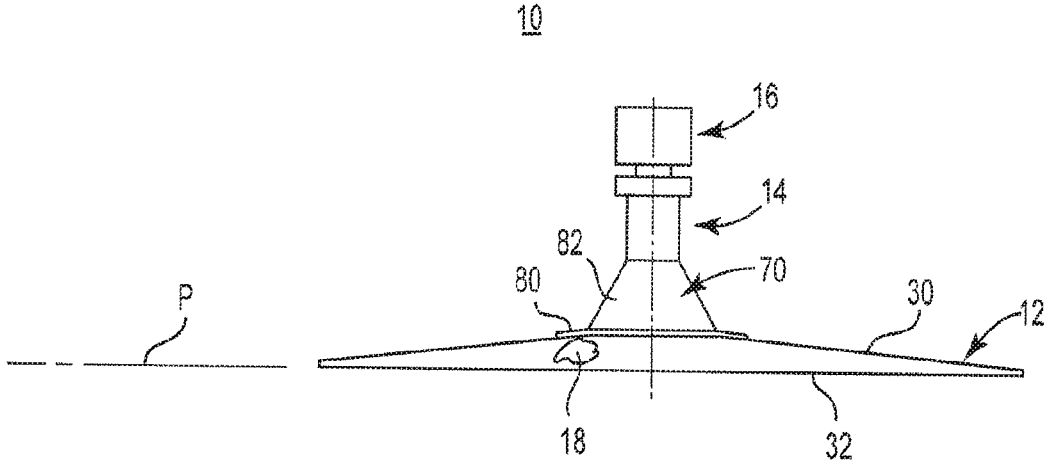
FIG. 2 is a side view of the pouch of FIG. 1 upon final assembly.

The pouch body 12 is defined, in some embodiments, by first and second major walls 30, 32 as best shown in FIG. 2. The walls 30, 32 are formed of a thin, flexible material (e.g., film) selected to be compatible with the components to be mixed within the pouch 10. For example, in some embodiments, the walls 30, 32 are a clear polyurethane film having a thickness of 0.01 inch and a hardness of 80-85 Shore A. Alternatively, a wide variety of other materials and/or material characteristics are also acceptable. Further, the walls 30, 32 can each be formed by a single film sheet, or one or both of the walls 30, 32 can be composed of a multi-layered, laminated film. Additionally, various additives or additional layers (e.g., a sealant layer, a barrier material coating, etc.)

can be employed. Regardless, the walls 30, 32 are characterized as being flexible, readily deflecting in response to forces applied thereto by the fingers/thumb of a typical human adult. Further, with configurations in which one or both of the walls 30 and/or 32 are formed of a translucent or transparent material (e.g., a translucent film), a user is afforded the ability to see through the wall(s) 30, 32 and can thus observe contents of the internal chamber 18. During use, then, a user is able to visually confirm whether adequate mixing is occurring (e.g., can see undesirable agglomerations or clumps of material) and take appropriate steps to rectify.

Figure 3:
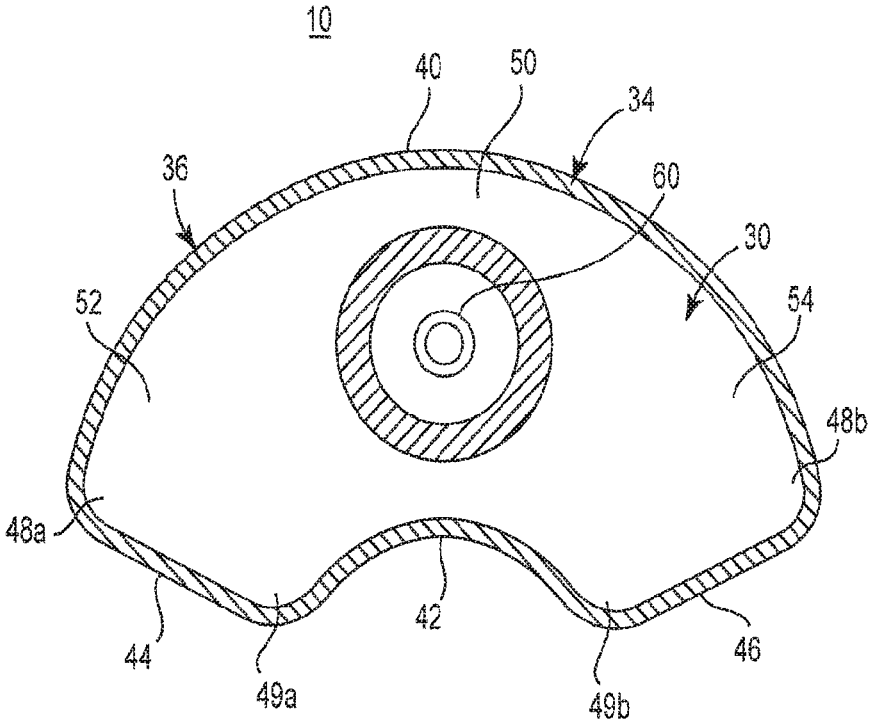
FIG. 3 is a top view of a pouch body portion of the pouch of FIG. 1.

The walls 30, 32 are, in some embodiments, identical in terms of size and shape. With this in mind, the top view of FIG. 3 illustrates the first major wall 30, it being understood that the second major wall 32 (hidden in FIG. 3, but shown in FIG. 2) has a size and shape commensurate with the first major wall 30. Upon final assembly, the walls 30, 32 are sealed to one another along their common peripheries by way of an edge seal 34. The edge seal 34 can be formed in a variety of manners, such as via welding (e.g., ultrasonic weld), heat seal, adhesive bonding, etc. Regardless, upon final assembly, the walls 30, 32 combine to define the pouch body 12, including the internal chamber 18 (referenced generally in FIG. 3) and a pouch perimeter 36.

The pouch perimeter 36 defines the pouch body 12 to have the C-like shape as described above (relative to a top or bottom view of the pouch body 12 as shown). In this regard, the pouch perimeter 36 generally includes opposing, first and second side edges 40, 42, and opposing, first and second end edges 44, 46. The side edges 40, 42 extend between the end edges 44, 46 in a curved fashion. In this regard, an arc length of the first side edge 40 (in extension between the end edges 44, 46) is greater than an arc length of the second side edge 42. In other words, relative to a common plane defined by the pouch perimeter 36, the curved extension of the side edges 40, 42 establishes the C-like shape described above. From this description, then, a linear length of the first side edge 40 (i.e., linear length between the intersection points 48*a*, 48*b*) is greater than a linear length of second side edge 42 (i.e., linear length between the intersection points 49*a*, 49*b*). The linear lengths of the side edges 40, 42 can assume a variety of dimensions, but in some embodiments, a linear length of the first side edge 40 is optionally on the order of 3.2-4.2 inches, alternatively on the order of 3.5-4.0 inches. The end edges 44, 46 each extend in a generally linear fashion between the side edges 40, 42, and have an approximately identical length (e.g., within 5%). A length of the end edges 44, 46 can optionally be on the order of 1.15-2.05 inches, alternatively, 1.35-1.95 inches, for example. Alternatively, one or more of the edges 40-46 can be formed to have characteristics differing from those described above. In the configurations shown, the intersection points 48*a*, 48*b*, 49*a*, 49*b* are each formed as a rounded or radiused corner (as opposed to a sharp, 90 degree-type corner). With this optional construction, components being mixed within the internal chamber 18 are less likely to undesirably collect within the intersection points 48*a*, 48*b*, 49*a*, 49*b*.

The C-like shape described above results in the pouch body 12 having a central portion 50, and first and second wing portions 52, 54 extending from opposite sides of the central portion 50. The wing portions 52, 54 are symmetrical relative to the central portion 50 in some embodiments, with the port assembly 14 being arranged within the central portion 50. With this construction, and as described in greater detail below, the wing portions 52, 54 can be deflected relative to the central portion 50, thereby forcing materials contained within the internal chamber 18 along the wing portions 52, 54 toward the central portion 50, and thus toward the port assembly 14. Further, the C-like shape promotes user handling of the pouch 10, with the wing portions 52, 54 effectively providing grasping surfaces or handles. In additional, the C-like shape has surprisingly been found to more readily direct materials contained within the internal chamber 18 toward the central portion 50/port assembly 14 upon folding of the wing portions 52, 54 as compared to a more linear geometric arrangement.

Regardless of an exact shape, the edge seal 34 renders the pouch perimeter 36 substantially inelastic. That is to say, while the pouch body 12 can be folded along the pouch perimeter 36 (e.g., into and out of the plane of FIG. 3), the pouch perimeter 36 will not overtly deflect or expand in the presence of an expansion force within the internal chamber 18. Thus, the pouch perimeter 36 maintains the C-like shape following loading of the internal chamber 18 with various components, as well as in the presence of squeezing forces imparted upon the walls 30, 32. In other words, an area of the internal chamber 18 as defined by the pouch perimeter 36 is constant, whereas a distance between the first and second walls 30, 32 is variable.

As indicated above, the first and second walls 30, 32 are identical in terms of size and shape. However, the first major wall 30 forms an aperture 60 (referenced generally in FIG. 3) about which the port assembly 14 is arranged. Thus, the aperture 60 facilitates fluid communication between the port assembly 14 and the internal chamber 18.

Returning to FIG. 1, the port assembly 14 can assume a variety of forms, and generally includes a port body 70 assembled to the first wall 30 of the pouch body 12. In some embodiments, the port assembly 14 further includes a fitting 72 (e.g., a plastic valve fitting) sized for assembly to the port body 70 and configured to facilitate sealed connection to a dispensing device (not shown), such as a syringe. Regardless, the port body 70 is formed of a relatively rigid material (e.g., a thick plastic) as compared to the flexible nature of the walls 30, 32, and defines a central passageway 74. Upon assembly of the port body 70 to the first wall 30, then, the passageway 74 is fluidly aligned with the aperture 60 (FIG. 3) in the first wall 30.

In some embodiments, the port body 70 includes a rim 80 and a stem 82. The rim 80 provides a surface for assembly of the port body 70 to the first wall 30, whereas the stem 82 establishes a conduit (i.e., the central passageway 74) through which materials can be dispensed into and from the internal chamber 18. With this in mind, and with specific reference to FIG. 2, the port body 70 is arranged, in some embodiments, so as to extend in a generally perpendicular fashion from the pouch body 12. Thus, for example, the stem 82 extends perpendicular to a common, major plane P defined by the pouch body 12/pouch perimeter 36. With this construction, when the second major wall 32 is placed on a flat surface, the port body 70/stem 82 extends in a perpendicular fashion relative to this flat surface, in some embodiments. With this arrangement provides a user with convenient access to the port assembly 14 while the pouch body 12 is held stable on the flat surface.

The port body 70 can be assembled to the first wall 30 in a variety of fashions, such as mounting the rim 80 to the first wall 30 (e.g., welding, adhesive bonding, etc.). In other embodiments, the port body 70 can be homogenously formed with the first wall 30, and the rim 80 can be eliminated. Further, the port body 70 can be supported relative to the first wall 30 with additional structures, such as ribs formed in the first wall 30 and/or rim 80.

The cap 16 can assume a wide variety of forms commensurate with features of the port assembly 14. More particularly, the cap 16 is configured to be releasably assembled to the port assembly 14, selectively opening and closing the central passageway 74 (FIG. 1). In other embodiments, however, the port assembly 14 can have a self-closing feature (e.g., a self-sealing membrane, check valve, etc.) such that the cap 16 is an optional component in accordance with the present disclosure.

The pouch 10 can be employed in mixing and dispensing a variety of compositions. In some embodiments, the pouch 10 is used in conjunction with a method of preparing a composition from two or more components. More particularly, in some embodiments, a first, powder component is mixed with a second, liquid component. By way of example, the powder component can be a carboxymethylcellulose (CMC) gel product in powder form, the liquid component is water, saline, or similar liquid, and the resulting composition is a bioresorbable material useful, for example, in medical procedures to prevent bleeding, tissue adhesion, etc. (e.g., the resultant composition has hemostatic properties and can be inserted into body cavities and/or orifices of a patient in the form of or applied to a stent). Alternatively, a wide variety of other compositions can be generated using the pouch 10. Regardless, with applications in which the pouch 10 is used to facilitate mixing of a powder component with a liquid component, the pouch 10 can be provided to a user "pre-loaded" with the powder component in the internal chamber 18.

Figure 4:
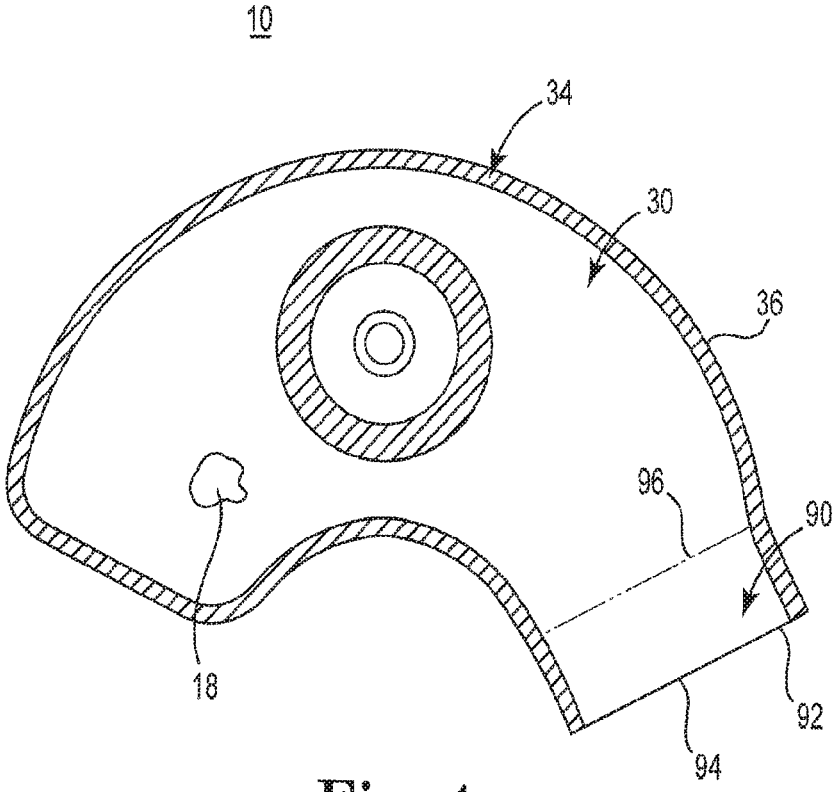
FIG. 4 is a top view of the pouch of FIG. 1 during manufacture in accordance with some embodiments.

In some embodiments, the powder component is placed into the internal chamber 18 during manufacture of the pouch 10. In particular, and with reference to FIG. 4, during manufacture, the pouch 10 is constructed as generally described above, except that the edge seal 34 is only partially formed along the pouch perimeter 36. More particularly, the walls 30, 32 (it being understood that the second wall 32 is hidden in the view of FIG. 4) are formed to define an overhang segment 90. A leading edge 92 of the overhang segments 90 are not sealed to one another, thereby defining an opening 94 into the internal chamber 18. The powder component(s) (not shown) or other component(s) can then be loaded into the internal chamber 18 via the opening 94. Following placement of a desired quantity of the powder (or other) component(s), the opening 94 is sealed closed, for example via an auxiliary seal 96 (shown in dashed lines in FIG. 4) that forms a contiguous portion of the edge seal 34. Where desired, the overhang segments 90 can then be removed, resulting in the pouch 10 configuration of FIG. 1. Other methodologies for placing one or more components within the internal chamber 18 are also acceptable, such as dispensing all components through the port assembly 14.

Figure 5A:
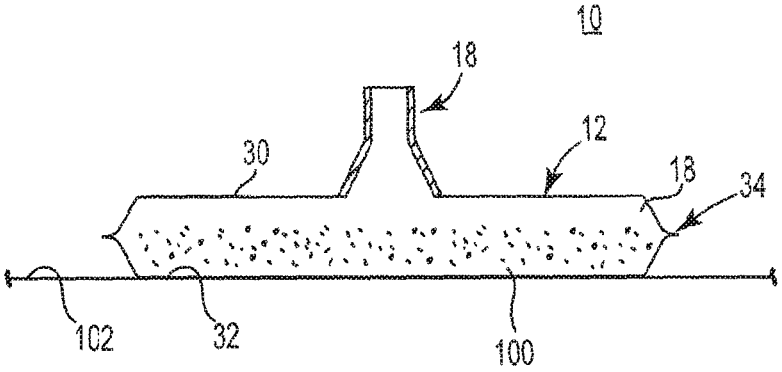
FIGS. 5A-5D illustrate use of the pouch of FIG. 1 in mixing and dispensing a composition.

Regardless of the manner in which component(s) are delivered into the internal chamber 18, FIG. 5A illustrates the pouch 10 having a first component 100 within the internal chamber 18. Once again, the first component 100 can assume a variety of forms, and with the one example embodiment illustrated in FIG. 5A is a powder. As further reflected in FIG. 5A, the pouch 10 can be placed on a flat surface 102, with the second wall 32 contacting the flat surface 102. As described above, with this arrangement, the port assembly 18 extends in a generally perpendicular fashion relative to the flat surface 102, and thus is conveniently accessible by a user. Further, the flat surface 102 supports the second wall 32, thus stabilizing the pouch 10.

Figure 5B:
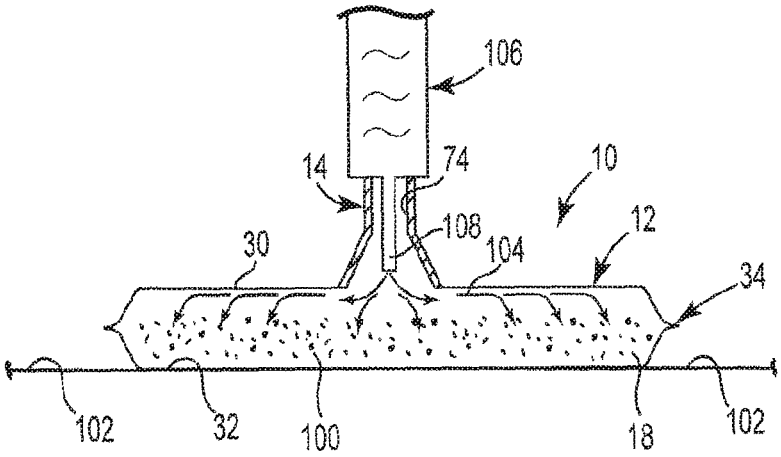

A second component 104 can then be added to the internal chamber 18 as shown in FIG. 5B. With the one, non-limiting example of FIG. 5B, the second component 104 is a liquid component that is delivered to the internal chamber 18 via a syringe 106. More particularly, the cap 16 (FIG. 1), where provided, is removed from the port assembly 14, and a dispensing end 108 of the syringe 106 fluidly connected to the central passageway 74. In this regard, the port body 70 supports the syringe 106/dispensing end 108 such that liquid flow (shown by arrows in FIG. 5B) into the internal chamber 18 occurs in a perpendicular fashion relative to the major plane P of the pouch body 12. This perpendicular flow, in turn, promotes a more uniform distribution of the liquid component 104 relative to the contained powder component 100, thus enhancing a more immediate, thorough mixing of the components 100, 104. Along these same lines, the perpendicular flow of the liquid component 104 experiences a capillary-like effect in flowing along the walls 30, 32 and through the powder component 100. In fact, it has surprisingly been found that with the arrangement of FIG. 5B, the liquid component 104 will flow in a perpendicular fashion along the first wall 30 and leach into the powder component 100 as illustrated by the arrows in FIG. 5B. This effectively promotes a more thorough distribution of the liquid component 104 to the powder component 100 with initial delivery of the liquid component 104 into the chamber 18.

Figure 5C:
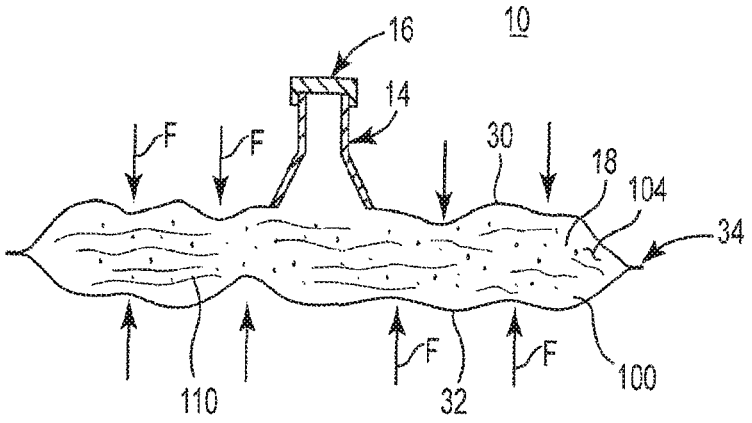

Once a desired volume of the second component (e.g., liquid) 104 has been dispensed into the internal chamber 18, the passageway 74 is closed, for example by securing the cap 16 (FIG. 1) to the port assembly 14. A user (not shown) then removes the pouch 10 from the flat surface 102 and performs a manual (i.e., by hand) mixing operation, kneading/mixing the components 100, 104 by repeatedly pressing or squeezing the walls 30, 32 toward one another at various locations. As shown in FIG. 5C, the walls 30, 32 will readily deflect toward one another in response to these hand-applied forces (indicated by arrows "F" in FIG. 5C), such that the components 100, 104 can be quickly and thoroughly mixed. The optional translucent or transparent characteristics of one or both of the walls 30 and/or 32 allows the user to visually confirm that desired mixing is occurring, as well as visual identification of clumping (as can frequently occur when mixing powder and liquid); similarly, the user can "feel" undesirable material clumps while manipulating the pouch body 12 during mixing. Following mixing, a composition 110 results.

Figure 5D:
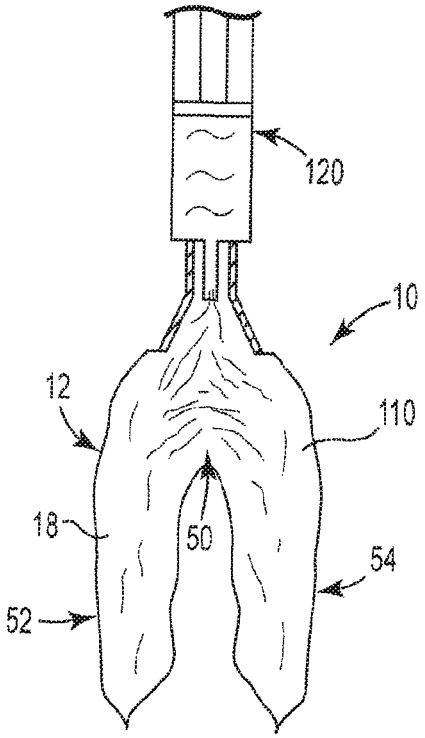

The composition 110 can then be withdrawn or dispensed from the internal chamber 18 in a variety of fashions, such as to a delivery system configured for applying the composition 110 as desired (e.g., as part of a medical procedure). For example, and as shown in FIG. 5D, a syringe 120 can be fluidly connected to the central passageway 74, and thus in fluid communication with the internal chamber 18. The syringe 120 can then be operated to form a vacuum-like condition within the internal chamber 18, thereby drawing the composition 110 into the syringe 120. To facilitate dispensement from the internal chamber 18, the pouch body 12 can be manipulated in a manner that directs a vast majority of any remaining amounts of the composition 110 into close proximity with the port assembly 14, and thus the syringe 120. For example, the wing portions 52, 54 can be pressed toward one another, thereby forcing portions of the composition 110 otherwise residing in the internal chamber 18 along the wing portions 52, 54 into the central portion 50, and thus toward the syringe 120. Alternatively, the composition 110 can be dispensed from the internal chamber 18 in a variety of other fashions that can include delivery systems differing from the syringe 120 shown.

The pouch of the present disclosure provides a marked improvement over previous designs. The C-like shape of the pouch body is inherently self-supporting, and promotes a more rapid, uniform mixing of contained components, as well as handling thereof by the hands of an adult human. Further, the port assembly arrangement promotes convenient introduction and removal of materials to and from the pouch body.

Although the present disclosure has been described with reference to preferred embodiments, workers skilled in the art will recognize that changes can be made in form and detail without departing from the spirit and scope of the present disclosure.

What is claimed is:

1. A handheld pouch for mixing and dispensing a composition, the pouch comprising:

a pouch body including:

opposing, first and second major flexible walls defining an internal chamber and a pouch perimeter, wherein the pouch body has a C-like shape configured to be held by a hand of a user, the walls readily deflecting in response to forces applied thereto by the hand of the user for mixing the composition within the internal chamber;

a rigid port body projecting from the first wall and fluidly open to the internal chamber; wherein the port body defines a central passageway having a first end for receiving a cap and a second end connected to the first wall; wherein the central passageway has a smaller diameter at the first end as compared to the second end;

wherein the pouch body is configured such that upon placement of the second wall on a flat surface, the pouch body deflects such that the pouch perimeter is parallel with the flat surface and the port body extends perpendicular relative to the flat surface; and a single component within the internal chamber, the single component being 100% carboxymethylcellulose powder.

2. The pouch of claim 1, wherein the pouch perimeter includes:

opposing, first and second end edges; and opposing, first and second side edges extending between the end edges;

wherein relative to a common plane defined by the end edges and side edges, the side edges are curved in extension between the end edges.

3. The pouch of claim 2, wherein relative to the common plane, the end edges are substantially linear in extension between the side edges.

4. The pouch of claim 2, wherein an arc length of the first side edge is greater than an arc length of the second side edge.

5. The pouch of claim 2, wherein a linear length of the first side edge is greater than a linear length of the second side edge.

6. The pouch of claim 1, wherein the pouch perimeter is substantially inelastic.

7. The pouch of claim 1, wherein the pouch body is configured to maintain the C-like shape in both an empty state and a filled state of the internal chamber.

8. The pouch of claim 1, wherein a volume of the internal chamber is defined by an area formed by the pouch perimeter and a distance between the first and second walls, and further wherein the pouch perimeter is constant and the distance between the first and second walls is variable as measured from the pouch perimeter to the port body.

9. The pouch of claim 1, wherein the C-like shape of the pouch body includes a central portion and opposing wing portions extending from the central portion, and further wherein the port body is provided within the central portion.

10. The pouch of claim 1, wherein extension of the port body from the first wall is perpendicular to a common plane defined by the pouch perimeter.

11. The pouch of claim 1, wherein the port body is configured to receive a dispensing end of a syringe device in a fluidly sealed manner relative to the internal chamber.

12. The pouch of claim 1, further comprising:

a cap selectively mounted to the port body opposite the first wall.

13. The pouch of claim 1, wherein the second end of the central passageway has a frustum conical shape.

14. The pouch of claim 1, wherein the first end of the central passageway has a cylindrical shape.

15. A combination for mixing and dispensing a composition, comprising:

a pouch body including:

opposing first and second major flexible walls that define an internal chamber and a pouch perimeter, wherein the pouch body has a C-like shape and a single component is positioned in the internal chamber, the walls being readily deflectable in response to forces applied thereto by a hand of a user, the C-like shape of the pouch body including a central portion and opposing wing portions extending from the central portion, the first wall defining an aperture; wherein the single component is 100% carboxymethylcellulose powder, and a rigid port body provided in the central portion and projecting from the first wall fluidly open to the internal chamber, wherein the port body defines a central passageway having a first end for receiving a cap and a second end connected to the first wall; wherein the central passageway has a smaller diameter at the first end as compared to the second end; further wherein the aperture facilitating fluid communication between the central passageway and the internal chamber and further wherein the pouch body is configured such that upon placement of the second wall on a flat surface, the pouch body deflects such that the pouch perimeter is parallel with the flat surface and the port body extends perpendicular to the flat surface; and a syringe having a second component and a dispensing end for positioning in the port body in a fluidly sealed manner relative to the internal chamber such that the syringe is fluidly coupled to the internal chamber and operated so as to deliver the second component through the dispensing end, through the central passageway and to the internal chamber.

16. The combination of claim 15, wherein the pouch perimeter includes:

opposing, first and second end edges; and opposing, first and second side edges extending between the end edges;

wherein relative to a common plane defined by the end edges and the side edges, the side edges are curved in extension between the end edges.

17. The combination of claim 15, wherein the pouch perimeter is substantially inelastic.

18. The combination of claim 15, wherein the pouch body is configured to maintain the C-like shape in both an empty state and a filled state of the internal chamber.

19. The combination of claim 15, wherein a volume of the internal chamber is defined by an area formed by the pouch perimeter and a distance between the first and second walls, and further wherein the pouch perimeter is constant and the distance between the first and second walls is variable as measured from the pouch perimeter to the port body.

20. The combination of claim 15, further comprising:

a cap selectively mounted to the port body opposite the first wall.

21. The combination of claim 15, wherein the second end of the central passageway has a frustum conical shape.

22. The combination of claim 15, wherein the first end of the central passageway has a cylindrical shape.

* * * * *